US011345511B1

(12) United States Patent
Franklin

(10) Patent No.: US 11,345,511 B1
(45) Date of Patent: May 31, 2022

(54) ARTIST'S IMPLEMENT CONTAINER AND BASE MOUNT

(71) Applicant: Travis Franklin, Sarasota, FL (US)

(72) Inventor: Travis Franklin, Sarasota, FL (US)

( * ) Notice: Subject to any disclaimer, the term of this patent is extended or adjusted under 35 U.S.C. 154(b) by 68 days.

(21) Appl. No.: 16/892,425

(22) Filed: Jun. 4, 2020

Related U.S. Application Data

(63) Continuation-in-part of application No. 29/733,556, filed on May 4, 2020, and a continuation-in-part of application No. 29/730,953, filed on Apr. 9, 2020.

(51) Int. Cl.

| | |
|---|---|
| ***B65D 21/028*** | (2006.01) |
| ***B65D 21/02*** | (2006.01) |
| ***B44D 3/00*** | (2006.01) |
| ***B65D 85/00*** | (2006.01) |

(52) U.S. Cl.
CPC ..... *B65D 21/0204* (2013.01); *B44D 3/00* (2013.01); *B65D 85/70* (2013.01)

(58) Field of Classification Search
CPC ..... B65D 2501/24649; B65D 2571/00074; B65D 19/44; B65D 2519/00815; B65D 1/36; B65D 21/0213; B65D 21/0209; B65D 21/0201; B65D 21/0202; B65D 21/0204; B65D 21/0205; B65D 21/0234; B44D 3/00; B44D 3/02; B44D 3/004; B44D 3/014; F16B 9/09; A47B 96/06; A47B 96/061; F16M 13/02; F16M 13/022
USPC ..... 248/200, 220.21, 224.8
See application file for complete search history.

(56) References Cited

U.S. PATENT DOCUMENTS

| | | | | |
|---|---|---|---|---|
| 2,594,287 | A * | 4/1952 | Budd | B65D 19/20 206/303 |
| 5,642,811 | A * | 7/1997 | Hubner | B65D 19/44 206/391 |
| 10,232,981 | B1 * | 3/2019 | Franklin | B65D 21/0204 |
| 2019/0256251 | A1 * | 8/2019 | Parazza | B65B 35/36 |
| 2020/0163478 | A1 * | 5/2020 | Hill | B65D 67/02 |

FOREIGN PATENT DOCUMENTS

| | | | | |
|---|---|---|---|---|
| DE | 2650399 | A1 * | 5/1978 | B65D 71/0096 |
| DE | 2904089 | A1 * | 8/1980 | B65D 71/50 |
| DE | 9109284 | U1 * | 9/1991 | B65D 71/0096 |
| DE | 9304895 | U1 * | 6/1993 | B65D 19/44 |
| GB | 789621 | A * | 1/1958 | B65D 85/34 |
| GB | 1118684 | A * | 7/1968 | B65D 75/32 |

* cited by examiner

*Primary Examiner* — Allan D Stevens
(74) *Attorney, Agent, or Firm* — Edward P. Dutkiewicz

(57) ABSTRACT

An Artist's implement container and base mount having a plurality upper hexagonal cells with a recess therein. The cells have double parallel linear hooks and single linear lips and a coupling strip, with a hole there through.
There is a plurality of lower hexagonal cells with a recess therein. The lower cells have plurality of double parallel linear hooks and single linear lips and a coupling strip, with a hole there through. Lastly, there is a base mount comprising a base portion and a bayonet connector.

13 Claims, 10 Drawing Sheets

FIG. 7
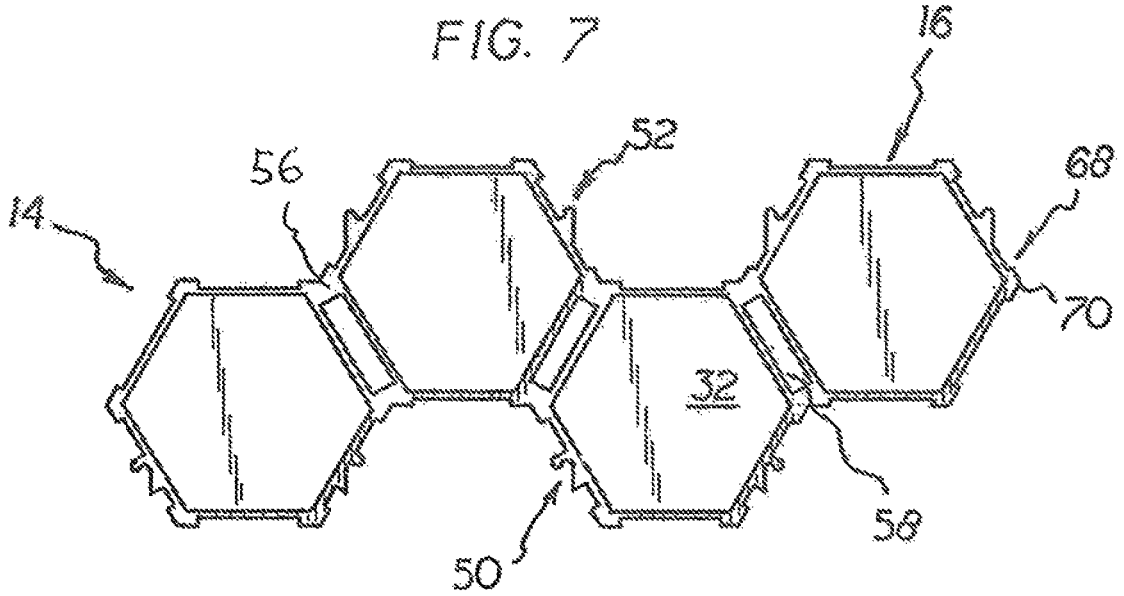
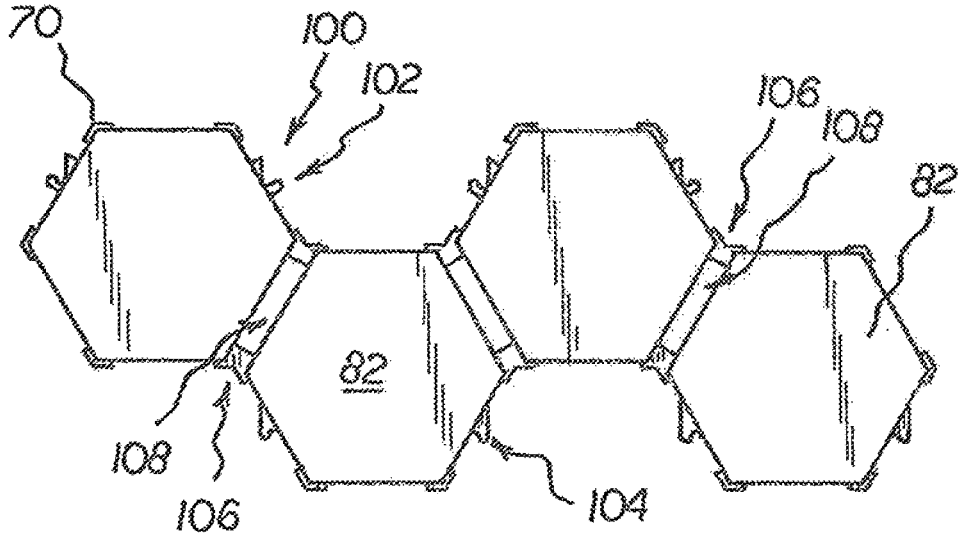
FIG. 8

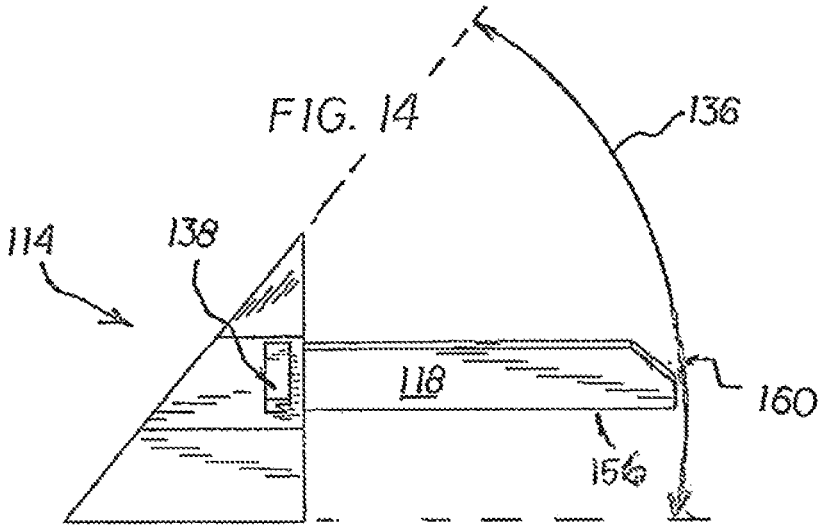
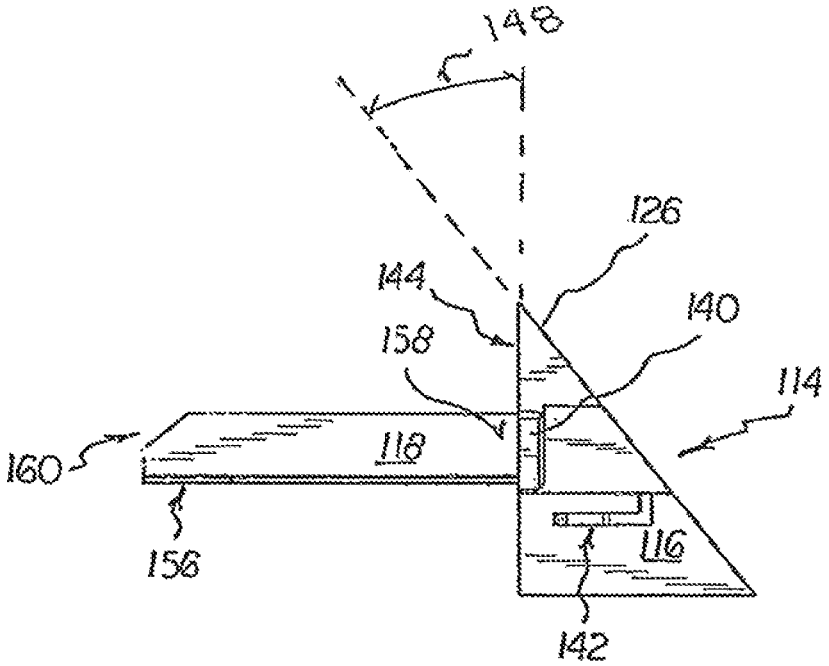
FIG. 15

FIG. 16
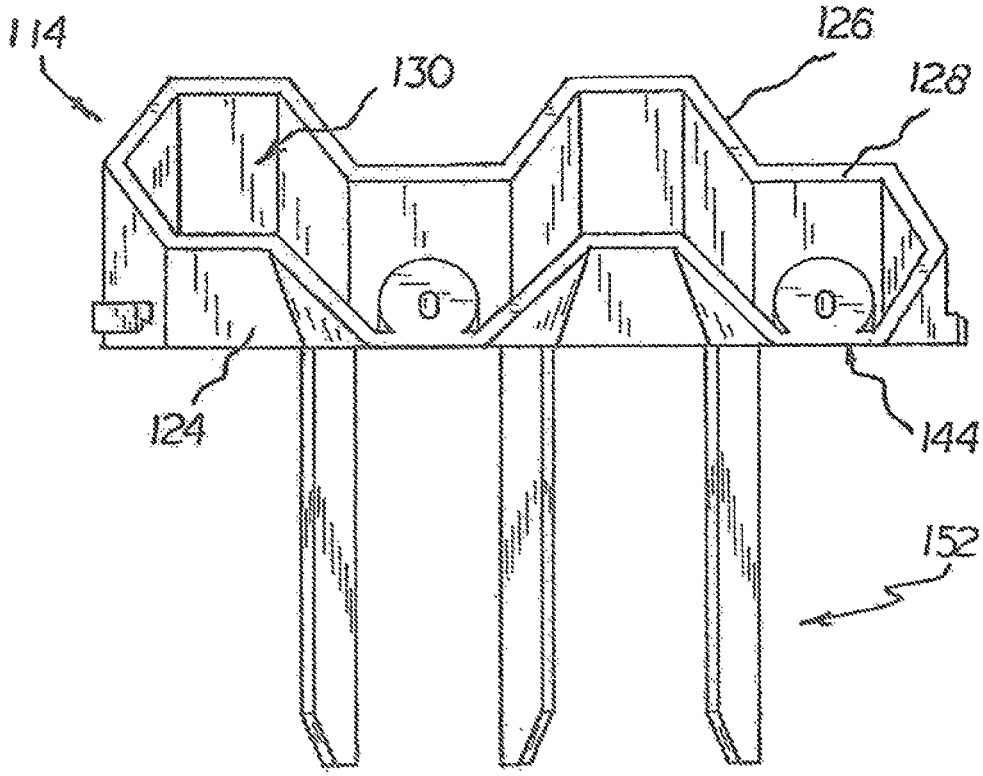
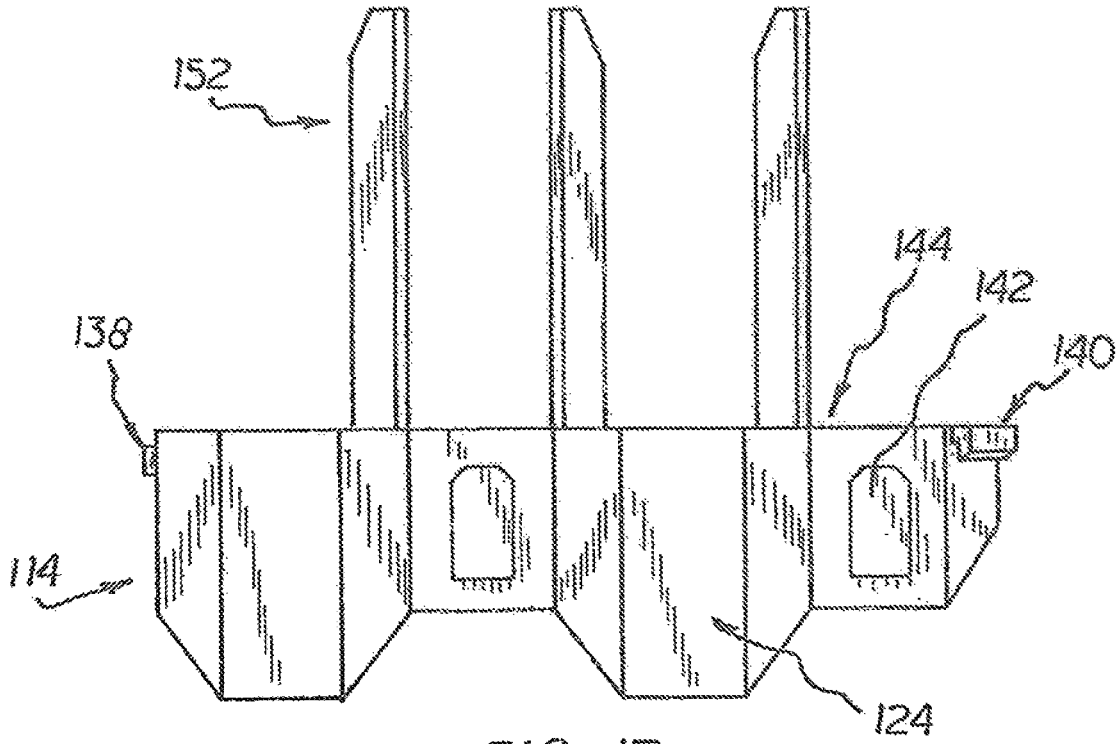
FIG. 17

ARTIST'S IMPLEMENT CONTAINER AND BASE MOUNT

CLAIM OF PRIORITY

This Application is a continuation-in-part of the following design patent applications:

Ser. No. 29/730,953; filed on Apr. 9, 2020; and

Ser. No. 29/733,556; filed on May 4, 2020;

and the Applicant claims the priority of each of the currently pending, above listed, patent applications.

BACKGROUND OF THE INVENTION

Rule 1.78(F) (1) Disclosure

The Applicant has submitted a related pending or patented non-provisional application within two months of the filing date of this present application. Priority of the pending previously filed applications is herein claimed. The invention is made by a single inventor, so there are no other inventors to be disclosed. This application is not under assignment to any other person or entity at this time.

There are related applications which are direct to, or related to, the present application, for which priority is claimed.

There is no research of development of this application which is federally sponsored.

FIELD OF THE INVENTION

The present invention relates to a artist's implement container and base mount and more particularly pertains to a device for containing and carrying artist's implements.

DESCRIPTION OF THE PRIOR ART

The use of containers for carrying artist's implements is known in the prior art. More specifically, containers for carrying artist's implements previously devised and utilized for the purpose of containment and transport of artist's implements are known to consist basically of familiar, expected, and obvious structural configurations, notwithstanding the number of designs encompassed by the prior art which has been developed for the fulfillment of countless objectives and requirements.

While the prior art devices fulfill their respective, particular objectives and requirements, the prior art does not describe artist's implement container and base mount that allows a device for containing and carrying artist's implements, which also has the added advantage of serving the functions of display and workplace usage.

In this respect, the artist's implement container and base mount, according to the present invention, substantially departs from the conventional concepts and designs of the prior art, and in doing so provides an apparatus primarily developed for the purpose of providing a device for containing and carrying an artist's implements.

Therefore, it can be appreciated that there exists a continuing need for a new and improved artist's implement container and base mount which can be used for containing and carrying artist's implements. In this regard, the present invention substantially fulfills this need.

SUMMARY OF THE INVENTION

In view of the foregoing disadvantages inherent in the known types of containers for carrying artist's implements now present in the prior art, the present invention provides an improved artist's implement container and base mount. As such, the general purpose of the present invention, which will be described subsequently in greater detail, is to provide a new and improved artist's implement container and base mount which has all the advantages of the prior art and none of the disadvantages.

In describing this invention, the word "coupled" is used. By "coupled" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially continuous with one another.

By adjacent to a structure is meant that the location is near the identified structure.

To attain this, the present invention essentially comprises an Artist's implement container and base mount, comprising several components, in combination.

There is an upper container comprising a plurality of hexagonally shaped cells. Each of the hexagonally shaped cells has a wall, with each of the walls of the upper container cells having an interior surface and an exterior surface. The upper container wall interior surface of each cell comprising six generally flat planes.

Each cell of the upper container having a closed upper end and an open lower end. The closed upper end of each upper container cell comprises an end cap. Each end cap is continuous with the upper container cell wall. Each end cap has an uppermost exterior with a generally flat configuration. Each end cap an interior, with the interior of each end cap having a lip. The exterior of each end cap has a hexagonal configuration. Each end cap has an exterior surface and an interior surface.

The open lower end of each cell of the upper container has a stepped configuration, thereby forming a seat on the lower end interior surface of each of the cells of the upper container. The closed upper end of each of the cells of the upper container are continuous, and directly joined, with the hexagonally shaped walls of the upper container cell, thereby forming a recess comprising of, and defined by, the interior surface of the upper container cell.

Each cell of the upper container has a connector means located on the exterior of the cell. The connector means may be any one of connector means which includes a snap, clip, hook and loop connector, pin and hole connector, and adhesive.

In the preferred embodiment the connector means is a plurality of double parallel linear hooks and a single linear lip. The exterior surface of each of the cells of the upper container wall has one of either a plurality of double parallel linear hooks or single linear lips. The double parallel linear hooks and single linear lips form a coupling mechanism.

The exterior walls of each of the upper container cells are continuously coupled to another cell by a coupling strip. Each coupling strip has a rectangularly shaped hole there through. Each rectangularly shaped hole has an upper extent and a lower extent.

The exterior surface of each of the cells of the upper container wall forms a joining angle. The joining angle for the hexagonal shape of each upper container is sixty degrees. Each joining angle has an interior surface and an exterior surface. Each exterior surface of each joining angle has a support portion.

There is a lower container comprising a plurality of hexagonally shaped cells. Each of the hexagonally shaped cells has a wall with each of the walls of the lower container cells having an interior surface and an exterior surface. The lower container wall interior surface of each cell comprising six generally flat planes.

Each cell of the lower container has a closed lower end and an open upper end. The closed lower end of each lower container cell comprises a base cap with each base cap being continuous, and directly joined, with the lower container cell wall. The base cap has a lowermost exterior having a generally flat configuration. Each base cap has an exterior surface and an interior surface. The base cap has an interior. The interior of each base cap is continuous with the walls of the lower container.

The open upper end of each cell of the lower container has an inwardly stepped configuration thereby forming a seat on the upper end exterior surface of each of the cells of the lower container. The inwardly stepped configuration of the upper end exterior surface of each of the cells of the lower container is sized to mate with, and be received within, the open lower end of the upper container cells.

The closed lower end of cells of the lower container are continuous with the hexagonally shaped wall of the upper container cell, thereby forming a recess. The recess comprises the interior surface of the lower container cell, and is defined by the interior surface of the lower container cell.

The exterior surface of each of the cells of the lower container wall has a connector means. The connector means may be any one of connector means which includes a snap, clip, hook and loop connector, pin and hole connector, and adhesive.

In the preferred embodiment the connector means is a plurality of double parallel linear hooks and a single linear lip. The exterior surface of each of the cells of the lower container wall has one of either a plurality of double parallel linear hooks or single linear lips. The double parallel linear hooks and single linear lips form a coupling mechanism.

The exterior walls of each of the lower container cells are continuously coupled to another cell by a coupling strip. Each coupling strip has a rectangularly shaped hole there through. Each rectangularly shaped hole of the coupling strip has an upper extent and a lower extent.

The exterior surface of each of the cells of the lower container wall forms a joining angle. The joining angle for the hexagonal shape of each lower container is sixty degrees. Each joining angle has an interior surface and an exterior surface. Each exterior surface of each joining angle of each lower container cell has a support portion.

In the preferred embodiment, the upper and lower container cells are located in a staggered configuration.

There is a base mount comprising a base portion and a bayonet connector portion. The base portion of the base mount comprises a plurality of hexagonally shaped units. The base mount base portion units are continuous with each other. In the preferred embodiment, the base mount base portion units are located in a staggered configuration.

Each base mount base portion unit has a plurality of side walls. Each side wall has a lowermost edge. The lowermost edge of each side wall of the base mount base portion units is located in a plane and forms a lowermost extent of a recess. Each recess is located within a unit of the base mount. Each recess of each unit of the base mount base portion has a screw boss located therein. Each screw boss has a screw hole there through. The screw hole is oriented in a direction which is perpendicular to the plane of the lowermost edge of each of the side walls.

Each of the side walls of each of the units of the base mount base portion are oriented at an acute angle relative to the lowermost extent of each of the side walls of the base portion units. At least one of the unit side walls has an upwardly directed connecting hook and an at least one of the unit side walls has a downwardly directed connecting hook. The at least one of the downwardly directed connecting hook and the at least one of the upwardly directed connecting hook are configured so as to be able to engage an upwardly directed connecting hook and a downwardly directed connecting hook, respectively.

At least one of the side walls of the base portion unit has an upwardly directed wire capture.

Each base portion unit has an upper extent which forms an exterior upper surface of each base portion unit. Each base portion unit upper extent is oriented at an acute angle relative to the lowermost edge of each side wall of the base portion lowermost extent of each of the units. The exterior upper surface of each base portion unit has a screw recess therein.

The bayonet connector portion comprises a plurality of elongated rectangular solid extensions. Each elongated rectangular solid extension of the bayonet connector portion of the base mount having an uppermost extent and a lowermost extent. The lowermost extent of each of the base mount bayonet connector portion extensions are continuous with the upper extent exterior upper surface of the base portion units. The uppermost extent of each of the bayonet connector portion elongated extensions each have a beveled end. The base mount bayonet connector portion extensions are located in alternating planes relative to each other. The extensions of the base mount bayonet connector portion are each configured and sized to be slip fit into the rectangularly shaped hole of the coupling strips of the upper container and the lower container.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved artist's implement container and base mount which has all of the advantages of the prior art containers, for carrying artist's implements, and none of the disadvantages.

It is another object of the present invention to provide a new and improved artist's implement container and base mount which may be easily and efficiently manufactured and marketed.

It is further object of the present invention to provide a new and improved artist's implement container and base mount which is of durable and reliable construction.

An even further object of the present invention is to provide a new and improved artist's implement container and base mount which is susceptible of a low cost of manufacture, with regard to both materials and labor, and which accordingly is then susceptible of low prices of sale to the consuming public, thereby making such artist's implement container and base mount economically available to the buying public.

Even still another object of the present invention is to provide an artist's implement container and base mount for efficiently containing and carrying artist's implements.

Lastly, it is an object of the present invention to provide a new and improved an Artist's implement container and base mount having a plurality upper hexagonal cells with a recess therein. The cells have double parallel linear hooks and single linear lips and a coupling strip, with a hole there through.

There is a plurality of lower hexagonal cells with a recess therein. The lower cells have plurality of double parallel linear hooks and single linear lips and a coupling strip, with a hole there through. Lastly, there is a base mount comprising a base portion and a bayonet connector.

It should be understood that while the above-stated objects are goals which are sought to be achieved, such objects should not be construed as limiting or diminishing the scope of the claims herein made.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a top plan view taken along line 7-7 of FIG. 3.

FIG. 8 is a top plan view taken along line 8-8 of FIG. 3.

FIG. 14 is a left side elevational view of the base mount.

FIG. 15 is a right side elevational view of the base mount.

FIG. 16 is top perspective view of the base mount.

FIG. 17 is a bottom perspective view of the base mount.

The same reference numerals refer to the same parts throughout the various Figures.

DESCRIPTION OF THE PREFERRED EMBODIMENT

Figure 1:
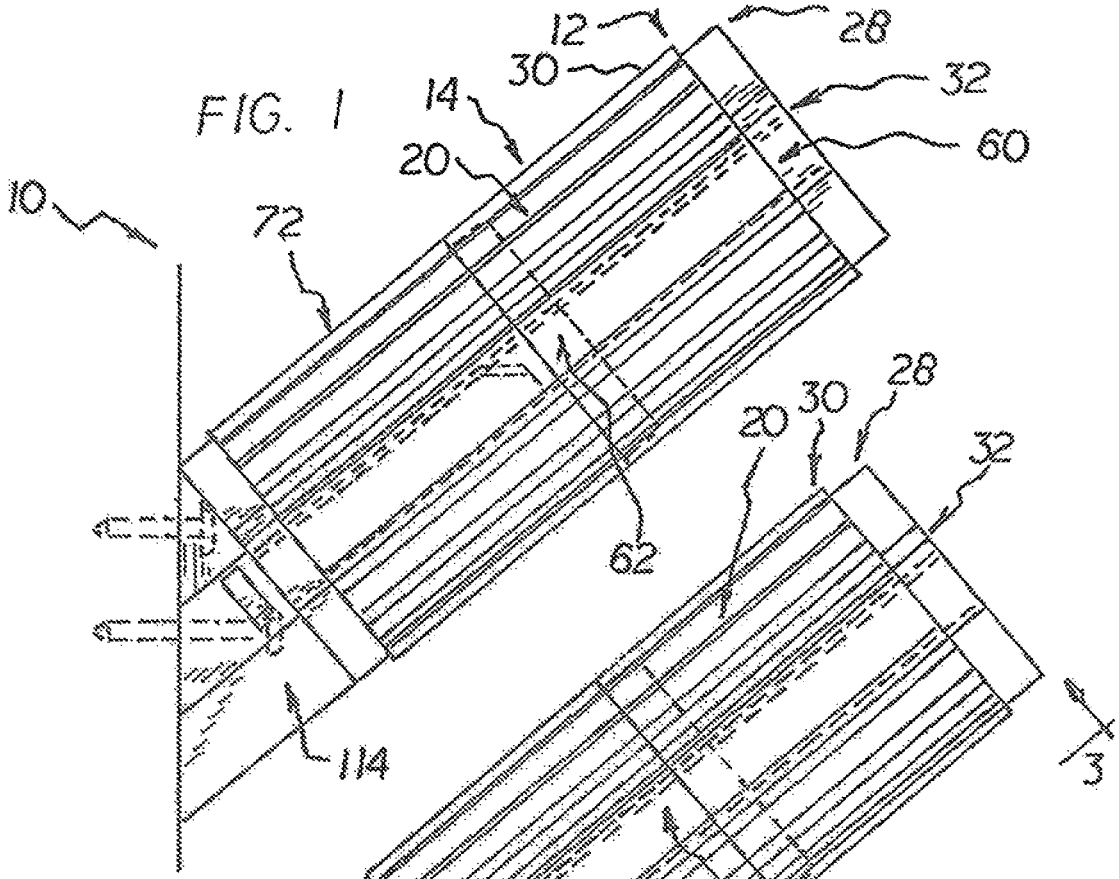
FIG. 1 is a left side elevational view of the upper and lower cells being joined, and mounted on the bayonet portion of the base mount. The screws for mounting the base mount on an existing wall are shown in broken line, as well as the bayonet portion being shown in broken line.

With reference now to the drawings, and in particular to FIG. 1 thereof, the preferred embodiment of the new and improved artist's implement container and base mount, embodying the principles and concepts of the present invention and generally designated by the reference numeral 10, will be described.

The present invention, the artist's implement container and base mount 10 is comprised of a plurality of components. Such components in their broadest context include an upper container, a lower container, and a base mount. Such components are individually configured and correlated with respect to each other so as to attain the desired objective. There is, herein, described, an Artist's implement container and base mount 10, comprising several components, in combination.

There is an upper container 12 comprising a plurality of hexagonally shaped cells 14. Each of the hexagonally shaped cells has a wall 16, with each of the walls of the upper container cells having an interior surface 18 and an exterior surface 20. The upper container wall interior surface of each cell comprising six generally flat planes 22.

Each cell of the upper container having a closed upper end 24 and an open lower end 26. The closed upper end of each upper container cell comprising an end cap 28. Each end cap is continuous with the upper container cell wall 30. Each end cap has an uppermost exterior 32 with a generally flat configuration. Each end cap an interior 34, with the interior of each end cap having a lip 36. The exterior of each end cap has a hexagonal configuration 38. Each end cap has an exterior surface 40 and an interior surface 42.

The open lower end of each cell of the upper container has a stepped configuration, thereby forming a seat 44 on the lower end interior surface of each of the cells of the upper container. The closed upper end of each of the cells of the upper container are continuous, and directly joined, with the hexagonally shaped walls of the upper container cell, thereby forming a recess 46 comprising of, and defined by, the interior surface of the upper container cell.

Each cell of the upper container has one of a connector means 48 located on the exterior of the cell. The connector means may be any one of connector means which includes a snap, clip, hook and loop connector, pin and hole connector, and adhesive.

In the preferred embodiment the connector means is one of either a plurality of double parallel linear hooks 50 or a single linear lip 52, which is located on the exterior surface of each of the cells of the upper container wall. The double parallel linear hooks and single linear lips form a coupling mechanism 54 and may be pushed together or slideably coupled to each other.

The exterior walls of each of the upper container cells are continuously coupled to another cell by a coupling strip 56. Each coupling strip has a rectangularly shaped hole 58 therethrough. Each rectangularly shaped hole has an upper extent 60 and a lower extent 62.

The exterior surface of each of the cells of the upper container wall forms a joining angle 64. Each joining angle has an interior surface 66 and an exterior surface 68. Each exterior surface of each joining angle has a support portion 70. The joining angle of the hexagonal shaped cell is sixty degrees.

There is a lower container 72 comprising a plurality of hexagonally shaped cells 74. Each of the hexagonally shaped cells has a wall with each of the walls of the lower container cells having an interior surface 76 and an exterior surface 78. The lower container wall interior surface of each cell comprising six generally flat planes 80.

Each cell of the lower container has a closed lower end 82 and an open upper end 84. The closed lower end of each lower container cell comprises a base cap 86 with each base cap being continuous with the lower container cell wall. The base cap has a lowermost exterior 88 having a generally flat configuration. Each base cap has an exterior surface 90 and an interior surface 92. The base cap has an interior 94. The interior of each base cap is continuous with, and joined directly to, the walls of the lower container.

The open upper end of each cell of the lower container has an inwardly stepped configuration 96 thereby forming a seat 98 on the upper end exterior surface of each of the cells of the lower container. The inwardly stepped configuration of the upper end exterior surface of each of the cells of the lower container is sized to mate with, and be received within, the open lower end of the upper container cells.

The closed lower end of cells of the lower container are continuous with the hexagonally shaped wall of the upper container cell, thereby forming a recess 98. The recess comprises the interior surface of the lower container cell, and is defined by the interior surface of the lower container cell.

The exterior surface of each of the cells of the lower container wall has a connector means 100. The connector means may be any one of connector means which includes a snap, clip, hook and loop connector, pin and hole connector, and adhesive.

In the preferred embodiment, the connector means is one of either a plurality of double parallel linear hooks 102 or single linear lips 104. The double parallel linear hooks and single linear lips form a coupling mechanism. Each cell of the upper container has a connector means located on the exterior of the cell.

The exterior walls of each of the lower container cells are continuously coupled to another cell by a coupling strip 106. Each coupling strip has a rectangularly shaped hole 108 there through. Each rectangularly shaped hole of the coupling strip has an upper extent 110 and a lower extent 112.

The exterior surface of each of the cells of the lower container wall forms a joining angle 64. Each joining angle has an interior surface 66 and an exterior surface 68. Each exterior surface of each joining angle has a support portion 70. The joining angle of the hexagonal shaped cell is sixty degrees.

There is a base mount 114 comprising a base portion 116 and a bayonet connector portion 118. The base portion of the base mount comprises a plurality of hexagonally shaped units 120. The base mount base portion units are continuous with each other. In the preferred embodiment, the base mount base portion units are located in a staggered configuration 122.

Each base mount base portion unit has a plurality of side walls 124. Each side wall has a lowermost edge 126. The lowermost edge of each side wall of the base mount base portion units is located in a plane and forms a lowermost extent 128 of a base recess 130. Each base recess is located within a unit of the base mount. Each recess of each unit of the base mount base portion has a screw boss 132 located therein. Each screw boss has a screw hole 134 there through. The screw hole is oriented in a direction which is perpendicular to the plane of the lowermost edge of each of the side walls.

Each of the side walls of each of the units of the base mount base portion are oriented at an acute angle 136 relative to the lowermost extent of each of the side walls of the base portion units. At least one of the unit side walls has an upwardly directed connecting hook 138 and an at least one of the unit side walls has a downwardly directed connecting hook 140. The at least one of the downwardly directed connecting hook and the at least one of the upwardly directed connecting hook are configured so as to be able to engage an upwardly directed connecting hook and a downwardly directed connecting hook, respectively.

At least one of the side walls of the base portion unit has an upwardly directed wire capture 142. Each base portion unit has an upper extent 144 which forms an exterior upper surface 146 of each base portion unit. Each base portion unit upper extent is oriented at an acute angle 148 relative to the lowermost edge of each side wall of the base portion lowermost extent of each of the units. The exterior upper surface of each base portion unit has a screw recess 150 therein.

The bayonet connector portion comprises the plurality of elongated rectangular solid extensions 152. Each elongated rectangular solid extension of the bayonet connector portion 118 of the base mount having an uppermost extent 156 and a lowermost extent 158. The lowermost extent of each of the base mount bayonet connector portion extensions are continuous with the upper extent exterior upper surface of the base portion units. The uppermost extent of each of the bayonet connector portion elongated extensions each have a beveled end 160. The base mount bayonet connector portion extensions are located in alternating planes 162 relative to each other. The extensions of the base mount bayonet connector portion are each configured and sized to be slip fit into the rectangularly shaped hole of the coupling strips of the upper container and the lower container.

Figure 2:
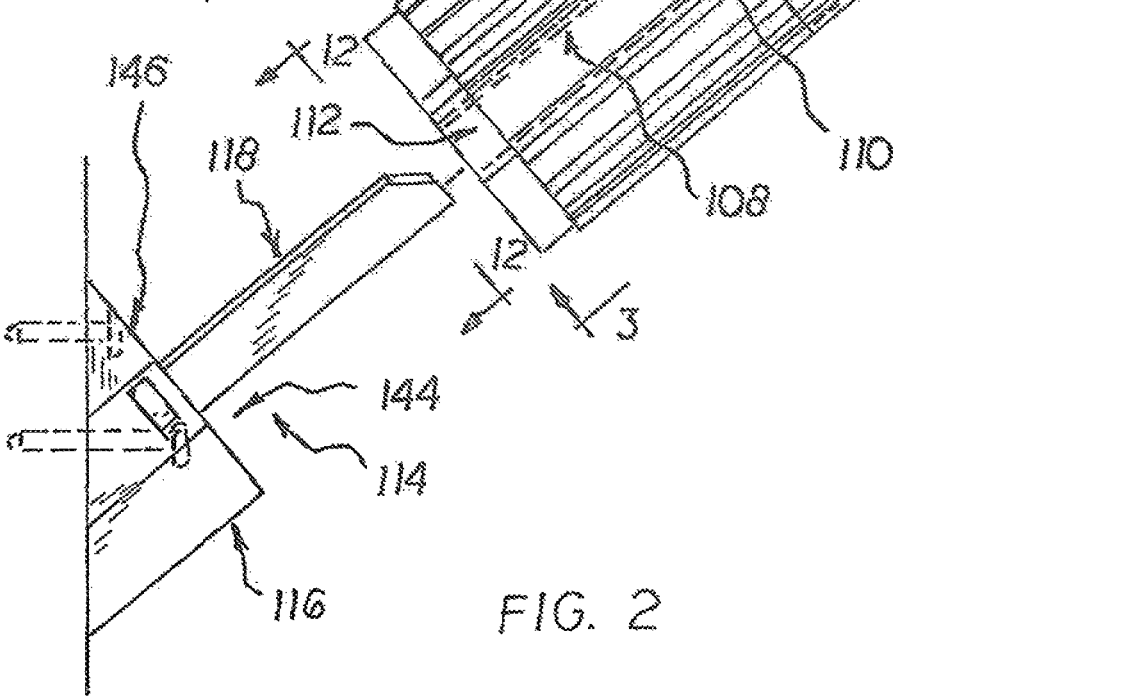
FIG. 2 is a left side elevational view of the upper and lower cells being joined and being removed from the bayonet portion of the base mount. The screws for mounting the base mount on an existing wall are shown in broken line. The rectangular hole through the coupling strip is sown in broken line.

The components of the artist's implement container may be used as a desk top located implement container with the base set on a desk top. The base may be fastened to a wall. The base may be set on the top a desk, and the bayonet connectors may be slipped into the coupling strip hole, wherein the upper and lower containers will be maintained at an angle relative to the desk top by the base The base may be fastened by a screw or bolt to a wall surface, which will maintain the containers, both upper container and lower container at an angle, relative to the wall surface, as shown in FIG. 2.

Figure 3:
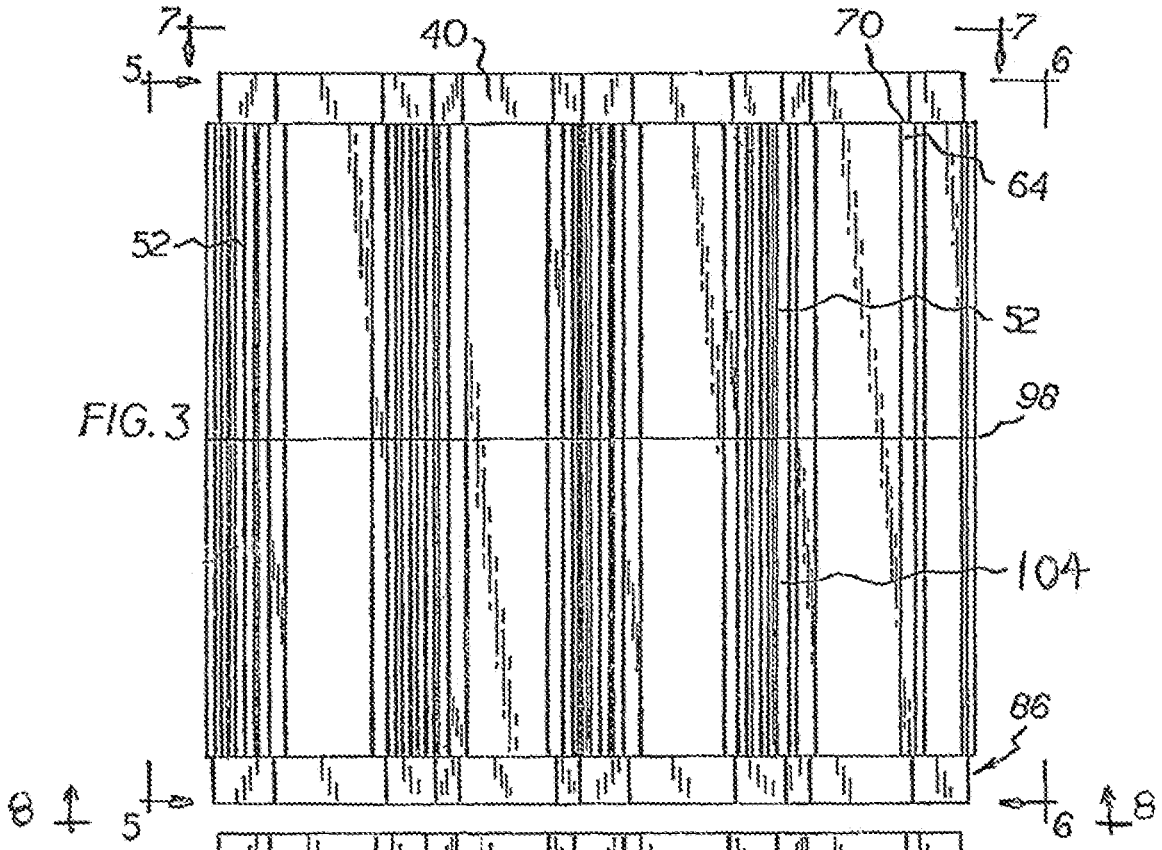
FIG. 3 is a front elevational view of the upper container cells and the lower container cells being joined together to form a closed container.
Figure 4:
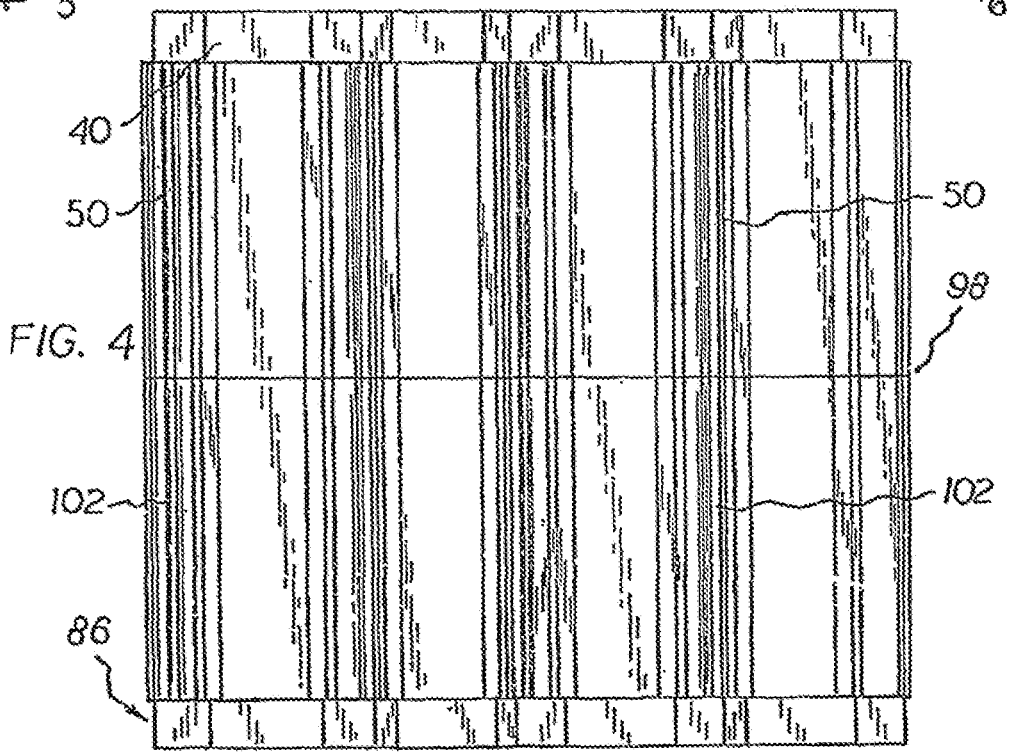
FIG. 4 is a rear elevational view of the upper container cells and the lower container cells being joined together to form a closed container.
Figure 5:
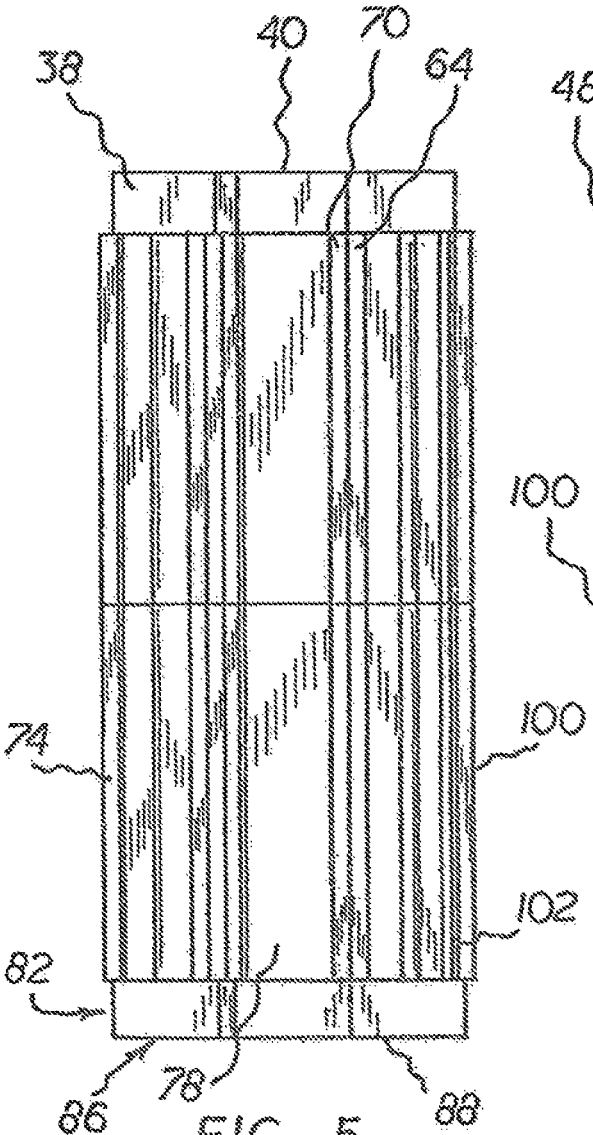
FIG. 5 is a left side elevational view taken along line 5-5 of FIG. 3, of the upper container cells and the lower container cells being joined together to form a closed container.
Figure 6:
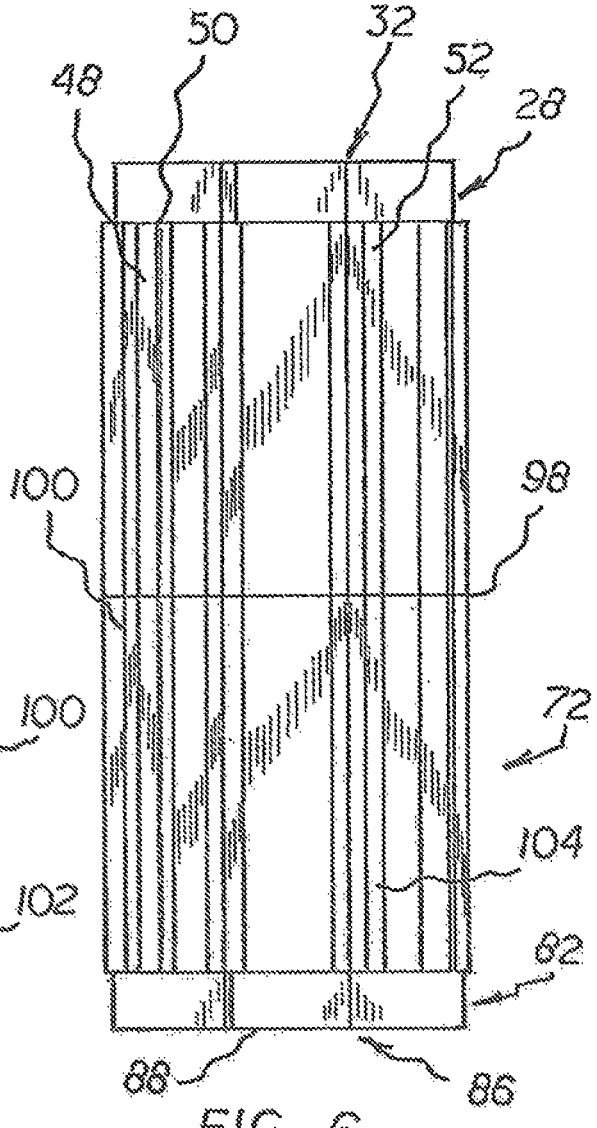
FIG. 6 is a right side elevational view taken along line 6-6 of FIG. 3, of the upper container cells and the lower container cells being joined together to form a closed container.
Figure 9:
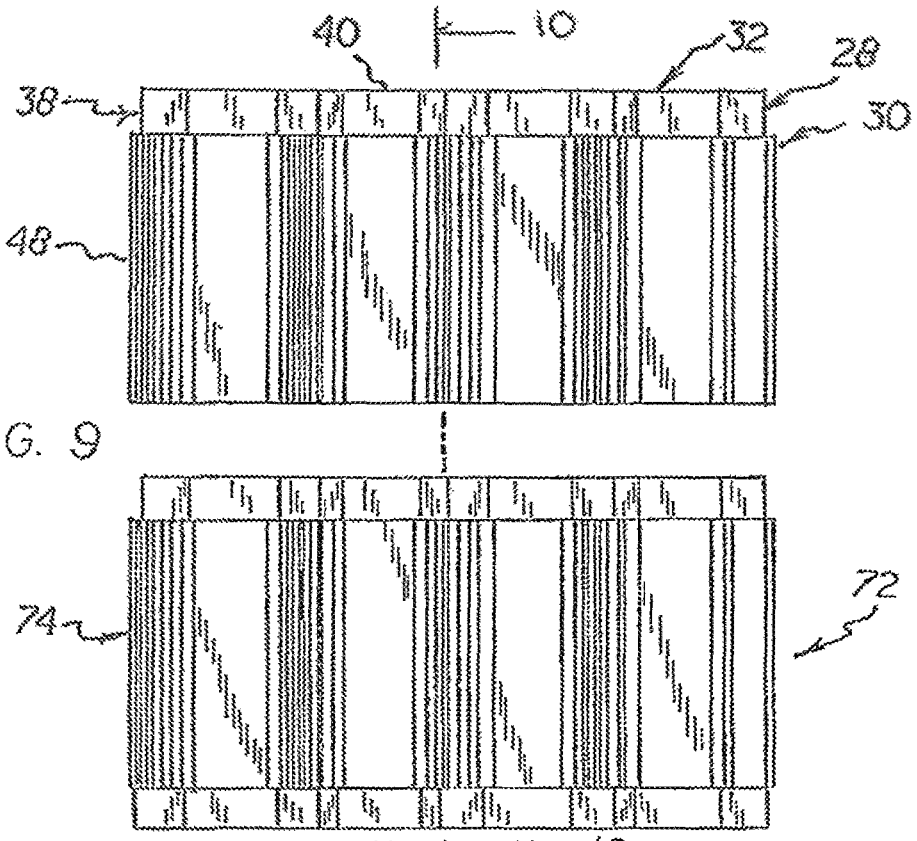
FIG. 9 is a side elevational view showing the upper container cells and the lower container cells being separated.
Figure 10:
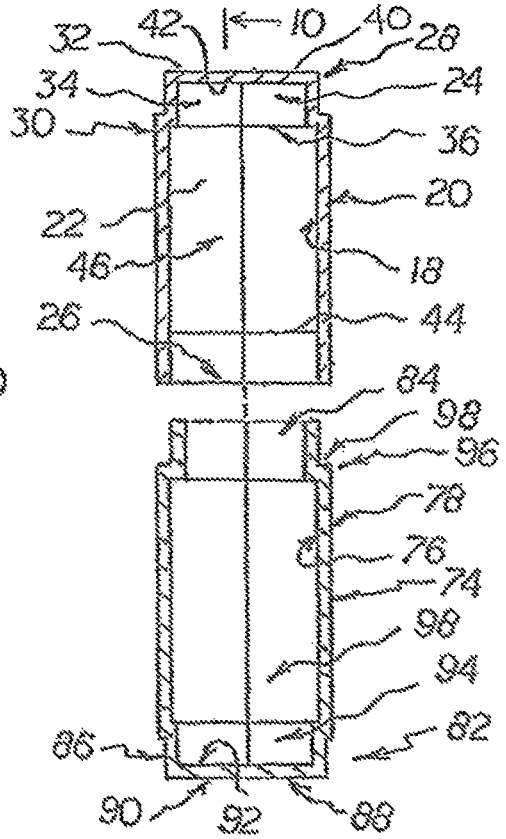
FIG. 10 is a side cross sectional view of FIG. 9, showing the interior of the upper container cell and the lower container cell relative to each other.
Figure 11:
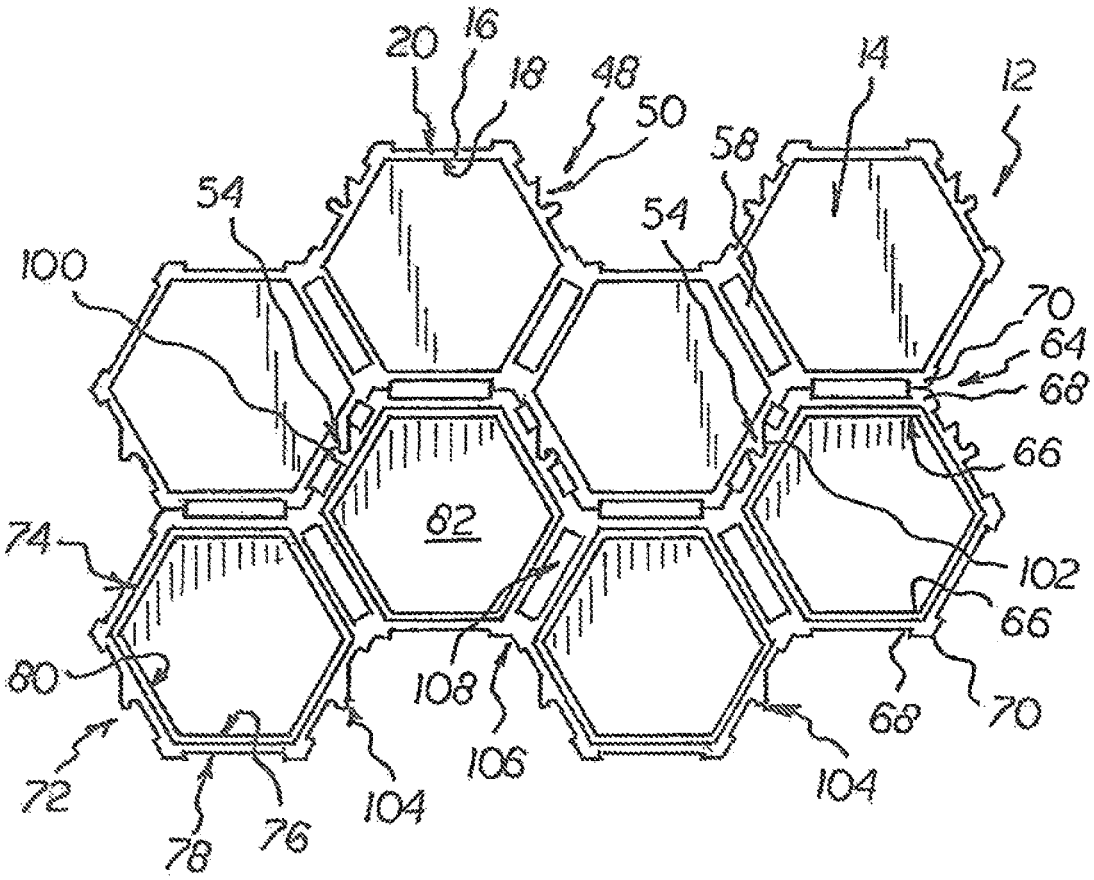
FIG. 11 is a top plan view showing the upper container cells and the lower container cells being removably and slideably coupled together, showing the relation of the double parallel linear hooks or single linear lips coupling mechanism, when engaged.
Figure 12:
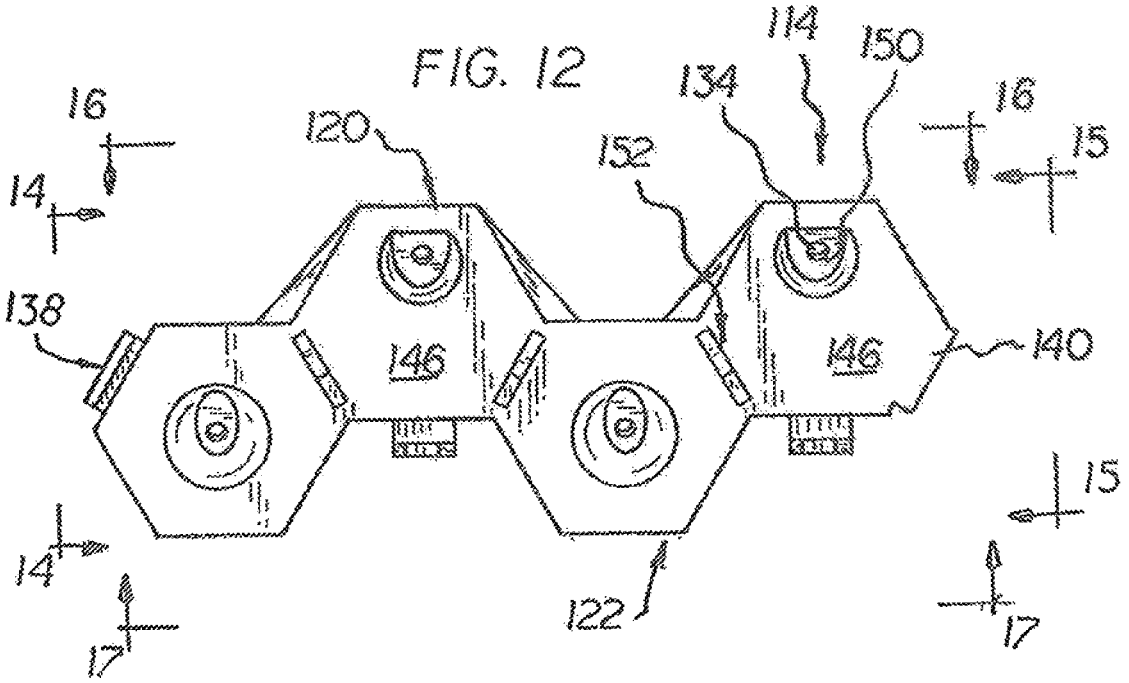
FIG. 12 is a top plan view of the base mount.
Figure 13:
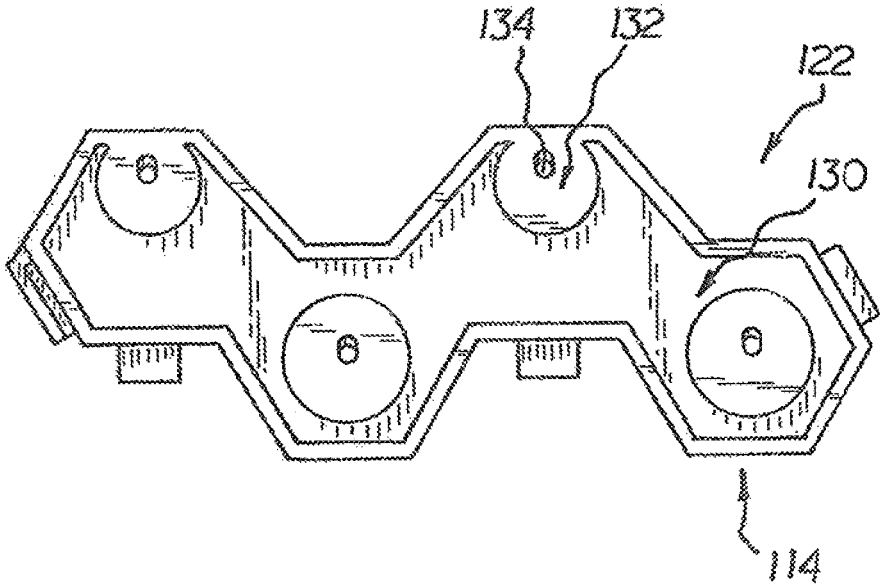
FIG. 13 is a bottom plan view of the base mount.
Figure 18:
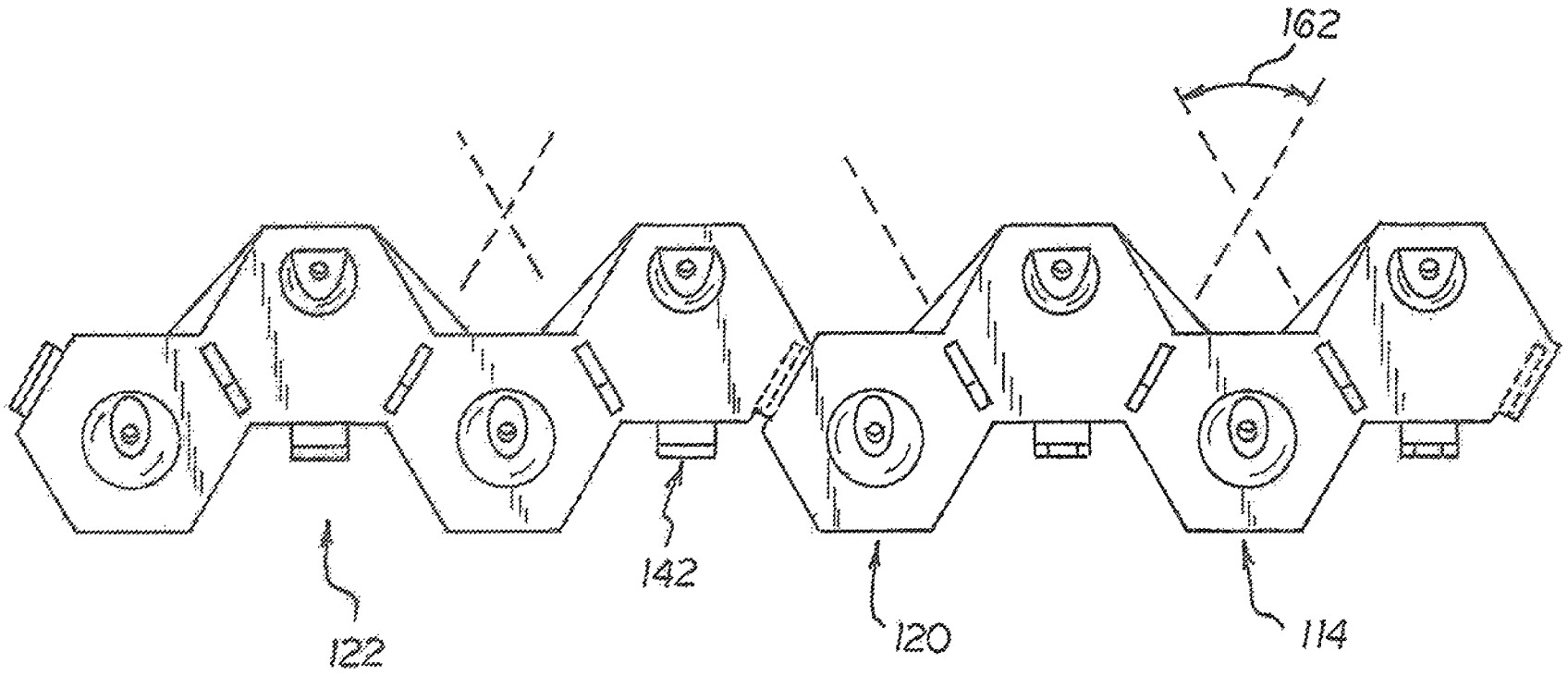
FIG. 18 is a top plan view of the base mount when joined to another base mount showing the downwardly directed connecting hook of the base mount being engaged with the upwardly directed connecting hook of the base mount, forming a continuous, two part, base mount. The alternating angles of the bayonet connector portions are shown in broken lines, and identified with an item reference number.

The upper container upper and the lower container, which is shown in FIGS. 3 and 4, may be separated, as shown in FIG. 9, which would allow a user to access the implements held within the upper container upper and the lower container. The upper and lower containers may be then coupled together, as shown in FIG. 11, with the open lower end of the upper container and the open upper end of the lower container being located in parallel planes, or in the same plane, as the coupling mechanism allow the upper container and the lower container to be slideably located to one another. The slideable coupling of the upper and lower containers allows a user to slide the upper container and the lower container relative to each other, enabling the coupled containers to be oriented at an angle, relative to a desk top, upon which the containers rest.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An artist's implement container and base mount, comprising, in combination:

an upper container comprising a plurality of cells, with each of the plurality of cells having a wall with each of the walls of the plurality of upper container cells having an interior surface and an exterior surface, each cell of the plurality of upper container cells having a closed upper end and an open lower end;

the closed upper end of each upper container cell comprising an end cap with each end cap being continuous with the upper container cell wall of each of the plurality of cells, each upper container end cap of each of the plurality of cells having an exterior surface and an interior surface;

the closed upper end of each of the plurality of cells of the upper container being continuous with the wall of that upper container cell thereby forming a recess within each upper container cell, each recess comprising an interior surface of its respective upper container cell;

the exterior surface of each wall having at least one connector means;

the exterior surface of the walls of each of the upper container cells of the plurality of cells being continuously coupled to another cell by an upper coupling strip, with each upper coupling strip having a hole therethrough, with each upper coupling strip hole having an upper extent and a lower extent;

a lower container comprising a plurality of cells, with each of the plurality of lower container cells having a wall with each of the walls of the plurality of lower container cells having an interior surface and an exterior surface, each of the lower container cells having a closed lower end and an open upper end;

the closed lower end of each of the plurality of lower container cells comprising a base cap with each base cap being continuous with the lower container cell wall of each lower container cell, each lower container base cap of each of the plurality of lower container cells having an exterior surface and an interior surface;

the closed lower end of each of the plurality of cells of the lower container being continuous with the wall of that lower container cell of each of the plurality of cells thereby forming a recess within each lower container cell, each recess comprising an interior surface of its respective lower container cell;

the exterior surface of each lower container wall having at least one connector means;

the upper container open lower end of each of the plurality of upper container cells and the lower container open upper end of each of the plurality of lower container cells being slidably coupleable to each other;

the exterior surface of the walls of each of the plurality of the lower container cells being continuously coupled to another cell of each of the plurality of lower container cells by a lower coupling strip, with each lower coupling strip having a hole therethrough, with each lower coupling strip hole having an upper extent and a lower extent;

the base mount comprising a base portion and a bayonet connector portion, the base portion comprising a plurality of units with the plurality of units being continuous with each other, each base portion unit having a plurality of side walls, with each of the plurality of side walls having a lowermost extent which forms an edge of the base mount base portion, each base portion unit having an upper extent forming an exterior upper surface of each base portion unit; and the bayonet connector portion comprising a plurality of extensions having an uppermost extent and a lowermost extent with the lowermost extent of each of the plurality of bayonet connector portion extensions being continuous with the upper extent exterior upper surface of the base portion units.

2. The artist's implement container and base mount as described in claim 1, with the artist's implement container and base mount further comprising:

the at least one connector means of the exterior surface of each of the upper container walls of the plurality of cells comprising a plurality of double parallel linear hooks and single linear lips; and the at least one connector means of the exterior surface of each of the lower container walls of the plurality of cells comprising a plurality of double parallel linear hooks and single linear lips, with the double parallel linear hooks and single linear lips forming a coupling mechanism.

3. The artist's implement container and base mount as described in claim 2, with the artist's implement container and base mount further comprising:

the upper container open lower end of each of the plurality of cells having a stepped configuration thereby forming a seat on the lower end interior surface of each of the plurality of cells of the upper container;

the lower container open upper end of each of the plurality of cells having an inwardly stepped configuration thereby forming a seat on the upper end exterior surface of each of the plurality of cells of the lower container; and the at least one connector means of the exterior surface of the lower container wall of each of the plurality of cells being the plurality of double parallel linear hooks and single linear lips.

4. The artist's implement container and base mount as described in claim 3, with the artist's implement container and base mount further comprising:

the end cap of each of the plurality of upper containers having an uppermost exterior;

the inwardly stepped configuration of the upper end exterior surface of each of the plurality of cells of the lower container being sized to mate with and be received within the open lower end of each of the plurality of upper container cells.

5. The artist's implement container and base mount as described in claim 4, with the artist's implement container and base mount further comprising:

the plurality of cells of the upper container being hexagonally shaped, the upper container wall inner surface of each of the plurality of cells comprising six planes;

the walls of each of the plurality of cells of the lower container being formed in a hexagonal shape;

the base mount base portion units being hexagonally shaped; and each side wall of the base portion units having a lowermost edge with the lowermost edge of each side wall of the base portion units being located in a plane and forming a lowermost extent of a recess located within each unit of the base mount.

6. The artist's implement container and base mount as described in claim 5, with the artist's implement container and base mount further comprising:

the interior of the end cap of each of the plurality of cells having a lip with the exterior of each end cap having a hexagonal configuration;

the lower container cell wall of each of the plurality of cells being hexagonally shaped;

each recess of each unit of the base mount base portion having a screw boss located therein; and the bayonet connector portion comprising a plurality of elongated extensions being rectangular.

7. The artist's implement container and base mount as described in claim 6, with the artist's implement container and base mount further comprising:

the hole through each coupling strips of the upper container and the lower container each having a rectangular shape;

the exterior surface of the wall of each of the plurality of cells of the upper container and the wall of each of the plurality of cells of the lower container forming a joining angle, with each joining angle having an interior surface and an exterior surface;

each base mount base portion screw boss having a screw hole therethrough;

an at least one of the unit side walls of the base mount base portion having an upwardly directed connecting hook and another at least one of the unit side walls having a downwardly directed connecting hook, with the at least one of the downwardly directed connecting hook and the at least one of the upwardly directed connecting hook being configured so as to be able to engage an upwardly directed connecting hook and a downwardly directed connecting hook, respectively; and the bayonet connector portion rectangular elongated extensions being solid.

8. The artist's implement container and base mount as described in claim 7, with the artist's implement container and base mount further comprising:

each exterior surface of each joining angle of each of the plurality of cells of the upper container and each of the plurality of cells of the lower container each having a support portion;

the screw hole of each base mount base portion being oriented in a direction which is perpendicular to the plane of the lowermost edge of each of the side walls of the base mount base portion;

each base mount base portion unit upper extent being oriented at an acute angle relative to the lowermost edge of each side wall of the base portion lowermost extent of each of the units; and the uppermost extent of each of the bayonet connector portion elongated extensions each having a beveled end.

9. The artist's implement container and base mount as described in claim 8, with the artist's implement container and base mount further comprising:

an at least one of the side walls of the base mount base portion unit having an upwardly directed wire capture; and the exterior upper surface of each base mount base portion unit having a screw recess therein.

10. The artist's implement container and base mount as described in claim 9, with the artist's implement container and base mount further comprising the bayonet connector portion extensions being located in alternating planes relative to each other.

11. The artist's implement container and base mount as described in claim 10, with the artist's implement container and base mount further comprising:

the extensions of the base mount bayonet connector portion being configured and sized to be slip fit into the rectangularly shaped hole of the coupling strips of the upper container and the lower container;

the plurality of cells of the upper container being oriented in a staggered configuration;

the plurality of cells of the lower container being oriented in a staggered configuration; and the plurality of units of the base mount base portion being oriented in a staggered configuration.

12. An artist's implement container and base mount, comprising, in combination:

an upper container comprising a plurality of cells, with each of the plurality of cells of the upper container having a closed upper end and an open lower end with the closed upper end of each of the plurality of cells of the upper container comprising an end cap, the upper container plurality of cells each having a recess therein, the upper container plurality of cells each having a wall with each wall having at least one connector means, each upper container cell being coupled to another upper container cell by an upper coupling strip, with each upper coupling strip having a hole therethrough;

a lower container comprising a plurality of cells, with each of the plurality of cells of the lower container having a closed lower end and an open upper end, the closed lower end of each of the plurality of cells of the lower container comprising a base cap, the plurality of cells of the lower container each having a recess therein, the plurality of cells of the lower container each having a wall with the wall having at least one connector means, each lower container cell being coupled to another lower container cell by a lower coupling strip, with each lower coupling strip having a hole therethrough, the lower container and the upper container being slidably coupled to form the artist's implement container in a closed state; and the base mount comprising a base portion and a bayonet connector portion, the base mount base portion comprising a plurality of units with each unit having a plurality of side walls and an upper extent forming an exterior upper surface, with the plurality of side walls forming an edge of the base mount base portion, the bayonet connector portion comprising a plurality of extensions each having an uppermost extent and a lowermost extent with the lowermost extent of each of the bayonet connector portion extensions being continuous with the upper extent exterior upper surface of the base portion units, the base mount bayonet connector portion extensions being slidably received into respective coupling strip holes of the upper container and the respective coupling strip holes of the lower container.

13. The artist's implement container and base mount as described in claim 12, wherein the at least one connector means of each cell wall of the upper container is located on an exterior surface of its respective cell wall and comprises one of either a plurality of double linear hooks and single linear lips and the at least one connector means of each cell wall of the lower container is located on an exterior surface of its respective cell wall and comprises one of either a plurality of double linear hooks and single linear lips, wherein the double parallel linear hooks of the upper container are configured to engage the single linear lips of the lower container so as to couple the upper container cells to the lower container cells.

* * * * *